United States Patent [19]

Woo et al.

[11] 4,104,023

[45] Aug. 1, 1978

[54] RING POLYSULFONATED ALKYLPHENOXY ALKYLOLS AS DETERGENTS

[75] Inventors: Gar Lok Woo, Tiburon; Ralph House, El Sobrante, both of Calif.

[73] Assignee: Chevron Research Company, San Francisco, Calif.

[21] Appl. No.: 699,402

[22] Filed: Jun. 24, 1976

Related U.S. Application Data

[62] Division of Ser. No. 97,302, Dec. 11, 1970, abandoned.

[51] Int. Cl.[2] ..... D06M 13/26

[52] U.S. Cl. ..... 8/137; 252/558

[58] Field of Search ..... 8/137; 252/558; 260/512 R

[56] References Cited

U.S. PATENT DOCUMENTS

| | | | |
|---|---|---|---|
| 2,178,830 | 11/1939 | Bruson | 260/512 R |
| 2,184,935 | 12/1939 | Bruson | 260/512 R |
| 2,271,635 | 2/1942 | Flett | 260/512 R |
| 2,828,334 | 3/1958 | De Groote | 260/512 R |

*Primary Examiner*—William E. Schulz

*Attorney, Agent, or Firm*—D. A. Newell; John Stoner, Jr.

[57] ABSTRACT

Detergent active materials which are effective in the absence of phosphate builders comprise ring polysulfonated alkylphenoxy alkylols of the formula:

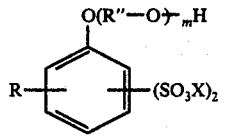

in which R is linear alkyl of 16 to 22 carbon atoms, R" is alkylene of 1 to 5 carbon atoms, X is H or a water-soluble salt-forming cation, and *m* is an integer of 1 to 10.

4 Claims, No Drawings

RING POLYSULFONATED ALKYLPHENOXY ALKYLOLS AS DETERGENTS

This is a division of application Ser. No. 97,302, filed Dec. 11, 1970, now abandoned, of which application Ser. No. 723,113, filed Sept. 14, 1976, is a continuation.

BACKGROUND OF THE INVENTION

This invention is concerned with certain ring polysulfonated alkylphenoxy alkylols which are effective as heavy duty detergent active material.

Increased concern over water pollution has produced significant changes in household detergents. Initially, major emphasis has been placed on producing biodegradable surface-active components for detergents. The shift to linear surface-active materials, including linear alkylbenzene sulfonate (LAS) and alpha-olefin sulfonates, etc., has reduced pollution attributed to nonbiodegradability.

However, the above-mentioned surface-active materials are inadequate in terms of soil removal in the absence of phosphate builders. Increasing evidence appears to indicate the phosphates contribute to the growth of algae in the nation's streams and lakes. This algae growth poses a serious pollution threat to the maintenance of clear, good domestic water supplies.

Consequently, there has developed a need for detergent active materials which will function successfully in the absence of phosphate builders. Recently, certain non-phosphate building materials have been proposed as replacements for the phosphates. Thus, materials such as the polysodium salts of nitrilotriacetic acid, ethylene diamine tetraacetic acid, copolymers of ethylene and maleic acid, and similar polycarboxylic materials have been proposed as builders. These materials, however, when employed with conventional detergent actives such as LAS, have, for one reason or another, not proved to be quite as effective as phosphates in detergent formulations. For example, some of the materials have proven to be insufficiently biodegradable to meet present and anticipated requirements.

It is therefore desirable to provide compounds which are effective as detergent active materials in the absence of phosphate builders and are also sufficiently biodegradable that their use results in contributing neither foam producers nor phosphates to the water supply.

In addition, in the past, with heavy duty detergents, it has been thought that to achieve good soil removal it was necessary to maintain a high pH in washing solutions. This concept, which began with the strongly alkaline laundry soaps, has continued to the present day LAS-phosphate combinations which are in widespread use in heavy duty detergent formulations. One apparent reason for this is that the alkylbenzene sulfonate detergents are not effective in heavy duty detergent formulations in the absence of a builder. The phosphate builders, for example, must be employed at a pH greater than 9 to be effective, and even the newer builders such as sodium nitriloacetate has a pH of about 9 in solution. The advantages to be gained with heavy duty detergents which may be employed at neutral pH are many. Deleterious effects from skin contact are lessened. Enzyme-type soil looseners may be more easily combined in neutral solutions. Injury to fabrics is minimized. It is, therefore, desirable to provide detergent active materials which, in addition to the previously mentioned nonpolluting characteristics, achieve their maximum detergency at or near neutral pH.

The formulation of liquid heavy duty detergent compositions achieves many desirable results. They are easy to package and measure, and their use opens the possibility of automatic dispensing in washing machines. However, in the past it has been impracticable to formulate heavy duty detergents in liquid form because of the insufficient solubility of the inorganic ingredients (phosphate builders, etc.) required for heavy duty applications and the high cost of organic substitutes for such inorganic ingredients. It is therefore highly desirable to provide detergent active materials having good water solubility and which, because of their excellent detergency without builers, can be formulated into effective, reasonably priced heavy duty liquid detergent formulations.

DESCRIPTION OF THE PRIOR ART

U.S. Pat. No. 2,106,716 discloses the products obtained by sulfating and sulfonating ether alcohols of the general formula $$A - R - O - R'(OH)_x$$

in which A is an alkyl group containing at least 8 carbon atoms, R is benzene or naphthalene nucleus, and R' is a member of the group consisting of alkylene radicals containing at least 2 carbon atoms and polyalkylene ether radicals in which the alkylene groups contain at least 2 carbon atoms, and $x$ represents a whole number less than 3. The product is sulfating and sulfonating the above compound has a sulfate group at the end of the alkyloxy chain and at least one sulfonate group on the ring. The alkyl groups exemplified by R include branched and unbranched materials of all position isomers from 8 to 18 carbon atoms.

In U.S. patent application Ser. No. 34,886, filed May 5, 1970, and divisional application Ser. No. 130,512, filed Apr. 1, 1971, now, respectively, U.S. Pat. No. 3,766,254, issued Oct. 16, 1973, and U.S. Pat. No. 3,816,353, issued Sept. 17, 1974, there are disclosed effective heavy duty detergent compositions which may be formulated without the necessity of phosphate builders by employing as the detergent active material polysulfonated alkylphenols of the formula

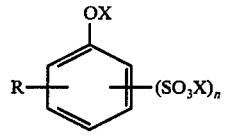

in which R is linear alkyl of 16 to 22 carbon atoms, X is H or a water-soluble salt-forming cation, $n$ is at least 1.5, and not more than 25 mol pecent of the sulfonated alkylphenols have R attached on the aromatic nucleus in a position para to —OX.

These materials, which have been shown to have superior detergent properties, however, are sensitive to the presence of chlorine-containing bleaches and contact between the detergent and bleach results in the formation of the color bodies in the liquid and reduction in detergent properties of the compound. It is therefore desirable to provide detergent active materials which retain the excellent phosphate-free detergent activity of these compounds and have reduced bleaching sensitivity.

SUMMARY OF THE INVENTION

Effective heavy duty washings may be accomplished with detergent compositions which may be formulated without the necessity of phosphate builders. These formulations employ as the major detergent active components ring polysulfonated alkylphenoxy alkylols of the formula

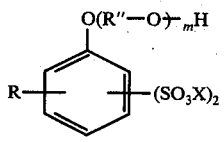

in which R is linear alkyl of 16 to 22 carbon atoms, R'' is alkylene of 1 to 5 carbon atoms, X is H or a water-soluble salt-forming cation, and *m* is an integer of 1 to 10.

The compounds of this invention do not require the presence of a builder to achieve good detergency, and while they are effective over a broad pH range, reach their maximum effectiveness at a pH near neutral in detergent solutions. Thus washing at a pH of 6.5 to 8.0, preferably 6.5 to 7.5, will give adequate soil removal while securing the previously mentioned advantages which inhere in the use of neutral washing solutions. Further, the compounds may be easily compounded into effective liquid heavy duty formulations because of the substantial solubility of the componds in water and because of the lack of need for adjunctive inorganic additives such as builders.

DESCRIPTION OF PREFERRED EMBODIMENTS

The salt-forming cation X may be any of numerous materials such as alkali metal, alkaline earth metal, ammonium, or various organic cations. Examples of suitable organic cations include amino materials such as those of the following structure:

$$NH_2^+(CH_2CH_2OH)_2 \text{ or } HN^+(CH_2CH_2OH)_3$$

The alkali metal cations are preferred, and sodium ions are particularly preferred. The alkyl groups represented by R are, as previously noted, linear, although the presence of a random methyl radical upon the linear chain, for example, may not adversely affect the performance of the compound. Alkyl radicals representative of R include hexadecyl, heptadecyl, octadecyl, nonadecyl, eicosyl, heneicosyl, and docosyl. Heptadecyl, octadecyl, nonadecyl, eicosyl, and heneicosyl groups are preferred.

Alkylene groups represented by R'' include ethylene, propylene, butylene, pentylene, etc. The ethylene group are preferred. The number of alkyloxy groups determined by *m* is preferably from 1 to 5, more preferably 1 to 3, and most preferably 1.

The componds of the invention are preferably prepared by sulfonation of a suitable alkylphenol followed by the reaction of the sulfonated alkylphenol with a suitable alkoxylating agent such as ethylene oxide, propylene oxide, butylene oxide, etc.

The alkylphenols which are suitable as precursors for the compounds of this invention are prepared by conventional alkylation methods. Such methods include thermal alkylation of phenol with an alpha olefin, thermal alkylation of phenol with an internal monoolefin, and catalytic methods of alkylation employing Friedel-Crafts catalysts such as $AlCl_3$, $ZnCl_2$, and $FeCl_3$, etc. Also suitable are various metal phenoxides, particularly those of aluminum and magnesium; hydrogen fluoride-treated aluminum silicate; alkyl sulfonic acids; benzene sulfonic acid; naphthalene sulfonic acid; transitional alumina; and gallium and indium oxides.

The alkyl groups represented by R are generally derived from alcohols, olefins, or haloparaffins. The position of the attachment of the aromatic nucleus on the alkyl chain may be at any point. With alpha olefins the predominant point of attachment of the alkylation product will be either of the 1 or 2 and principally at the 2 position of the chain. On the other hand, with a mixture of isomerized olefins or olefins derived from haloparaffins which have, in turn, been produced by halogenation of paraffins, the position of the double bond will be generally completely random on the chain, and thus the corresponding alkyl chain-nucleus attachment will be random.

The suflonation of the alkylphenols to produce the compounds of this invention may be accomplished by any suitable method. Thus, materials which may be reacted with the alkylphenol include chlorosulfonic acid, oleum, or sulfuric acid. It is only important that enough sulfonating agent be employed to incorporate an average of at least 1.5, preferably more than 1.6 atoms of sulfur (in the form of sulfonate groups) into each molecule. Each sulfonate group incorporated into these alkylphenols can be measured as a surface active site by titration. This number is referred to as active group incorporation (AGI). Sulfonation with oleum is preferred.

The sulfonation is usually accomplished with a ratio of at least 2 and preferably from 4 to 10 mols of available $SO_3$ from the sulfonating agent to one mol of the alkylphenol. The use of a solvent is ordinarily not required in carrying out the sulfonation. The alkylphenol and the sulfonating agent are simply mixed and the reaction is allowed to proceed, maintaining the temperature of the reaction mixture within the desired limits. The time required for disulfonation will be dependent upon the reaction temperature, the sulfonating agent, the ratio of sulfonating agent to alkylphenol, and the total quantity of reactants present. The reaction is usually effected at a temperature in the range of 0° to 150° C, preferably 25° to 100° C.

After sulfonation, the product may be neutralized with a water-soluble, salt-forming cationic neutralizing agent, usually a metal oxide or hydroxide, and preferably an alkaline earth metal or alkali metal hydroxide. The alkali metal hydroxides are preferred, and most preferred is sodium hyroxide.

The reaction of the sulfonated phenol with the alkylene oxide is preferably accomplished in the following manner:

The alkylene oxide may be reacted with the alkylphenol disulfonate under acid, neutral or basic conditions, at pressures varying from 0 to 150 psi, over a temperature range of from about 0° to 200° C. The alkylene oxide:alkylphenol ratio is maintained at a molar ratio in the range of from about 1:1 to 10:1, preferably 1:1 to 5:1.

While the reaction may be carried out over a wide pH range, it is preferable that the reaction is effected in the presence of a basic catalyst such as sodium hydroxide. Thus the condensation will take place between the oxide and alkali metal salt of the alkylphenol disulfonate.

The basic catalysts which may be employed include alkali metal hydroxides, alkaline earth metal hydroxides, and other basic metal oxides and hydroxides which are soluble in water. An amount of the catalyst sufficient to maintain the pH of the reaction mixture above about 8 and preferably between about 8 and 11 is preferred.

According to the preferred procedure for the above reaction, the alkylphenol disulphonate or alkylphenol disulfonic acid is mixed with a sufficient quantity of base to place the pH in the desired range. The reaction may be effected in an open or a closed vessel with stirring. The alkylene oxide is preferably added to the vessel through an inlet tube below the surface of the water solution. The addition of the alkylene oxide is controlled to produce the proper amount of condensation.

After completion of the reaction, the material may be recovered by conventional techniques. It is particularly desirable to effect the recovery of the product in the following manner: The solution is evaporated to dryness, preferably under a vacuum. It is then extracted with a solvent such as ether or tetrahydrofuran to remove glycol by-products such as ethylene glycol or polyethylene glycol, etc. The dry material is then dissolved in ethanol and sodium methoxide is added to precipitate unreacted alkylphenol disulfonic acid. This material is removed by filtration, and the filtrate is again evaporated to dryness to isolate the desired detergent product.

The product, which may contain a substantial quantity of water, depending upon the separation technique employed, and from 1 to 4 parts of a normally inorganic sulfate from the neutralization of excess $SO_3$ (e.g., $Na_2SO_4$), may be use, as is, in combination with conventional detergent additives to formulate liquid heavy duty detergents. Alternatively, water may be removed in any quantity to complete dryness by conventional concentration techniques such as evaporation, distillation, drum drying, etc., to yield a concentrated solution, a slurry, or a dry particulate solid which may then be blended to form a heavy duty detergent.

The solid product isolated as described above may be desalted by the usual procedures as used in the alkylbenzene sulfonate art. In this method the solid material is mixed with about a 70/30 alcohol/water solution. The insoluble inorganic sulfate is removed by filtration, and the inorganic surfactant may be used as such or isolated by evaporation of the solvent. The liquid concentrates and slurries may be treated in similar fashion with allowance made for the quantity of water already present. These desalting procedures gives a deteregent product that is essentially free of inorganic salt.

The following examples describe the preparation of the compounds of this invention.

EXAMPLE 1

Preparation of a Mixture of Octadecyl-, Nonadecyl-, and Eicosylphenol Disulfonates A mixture of about equal amounts of octadecenes, nonadecenes, and eicosenes was prepared by isomerization of the corresponding mixture of 1-isomers. This mixture was employed to alkylate the phenol. The crude alkylphenol was distilled, and the fraction having a boiling range of 444° to 472° F at 5 mm/Hg was taken as the product. Analysis of this product showed it to contain over 96% ortho alkyl isomers.

A 360 g. portion of the distilled alkylphenol mixture was charged to an 800 ml. sulfonater equipped with a thermometer, dropping funnel, reflux condenser, and mechanical stirrer. While the material was being strongly agitated, 514 g. of 21.5% fuming sulfuric acid was added through the dropping funnel over a period of 36 minutes while the temperature was maintained at from 5 to 10° C. The temperaure was then raised to 75° C for 30 minutes. The reaction was then quenched by dropping the product onto ice, cooling it to a temperature of 0°-5° C. The product was then neutralized with 490 ml. of 50% NaOH. The final volume was adjusted to 2700 ml. Analysis of the mixture by Hyamine titration* and dilute acid hydrolysis showed a 95% yield of alkylphenol disulfonate.

See method of House and Darragh, Anal. Chem., 26, 1492 (1954).

EXAMPLE 2

Ethoxylation of Alkylphenol Disulfonate at a pH of 8.0

A solution of the product of Example 1 was concentrated and brought to a pH of 8.0 with NaOH. The final concentration of the material was 21.4% active and contained about equal amounts of active and sodium sulfate. To 10.31 g. of the solution (2.2 g. or 0.004 mol active) in a 95 ml. Fischer-Porter tube was charged 0.42 g. (0.0095 mol) of ethylene oxide. The system was closed and stirred magnetically in an oil bath at 78° C. The temperature was gradually raised to 99° C in about an hour's time and then maintained at 96°-102° C for about 16 hours. The maximum pressure reached near the beginning was about 14 psig. The pressure near the end of the reaction was in the range of 0-2 psig. The material was cooled to room temperature. Analysis by ultraviolet analysis at 308 mμ wavelengths (absorption by phenolic hydroxyl) showed 90% capping of the phenolic group.

EXAMPLE 3

Ethoxylation of Alkylphenol Disulfonate at a pH of 9.1

The procedure of Example 2 was followed with the exception that the pH of the starting material was 9.1. Essentially equivalent results were obtained.

EXAMPLE 4

Ethoxylation of Alkylphenol Disulfonate at a pH of 12.5

The procedure of Example 2 was followed with the exception that the pH of the initial material was brought to 12.5 by addition of 50% aqueous sodium hydroxide. In this case no alkoxylated product was obtained.

The procedures were repeated with a pH varying between 8 and 11.2. Substantial yields were obtained at each of these pH's.

The compounds of this invention are useful as heavy duty detergent actives. In the past, heavy duty detergent formulations useful for removing soil from textiles have comprised an organic surfactant (detergent) and an inorganic phosphate builder; the phosphate being present by weight, in an amount of from one to four times that of the detergent. The compounds of the present invention are excellent soil removers without the aid of any phosphate builder. That is, the compounds of this invention satisfy all need for both organic surfactant and builder in the final heavy duty detergent formulation. One way that this may be accomplished is by preparing a mixture of the disulfonate materials of the instant invention and an inert material, e.g., water, sodium sulfate, sodium carbonate, etc. Such mixtures may contain any amount of disulfonate in excess of about 10%, preferably 15% or more. One useful composition comprises from 30 to 50% disulfonate and the remainder, sodium sulfate. Many other combinations make useful formulations and may be either liquid solutions or particulate solids.

As heavy duty detergents, it is contemplated that the disulfonate compounds will be used in wash water at concentrations of about 0.01 to about 0.10%. This is within the same range of concentrations as are employed with the present day commercial detergents. In other words, the soil removal properties of the present compounds are essentially equivalent to the soil removal properties of an equal amount of the current commercial surfactant combined with at least an equal amount of phosphate.

Detergency of the compounds of the present invention is measured by their ability to remove natural sebum soil from cotton cloth. By this method, small swatches of cloth, soiled by rubbing over face and neck, are washed with test solutions of detergents in a miniature laboratory washer. The quantity of soil removed by this washing procedure is determined by measuring the reflectances of the new cloth, the soiled cloth, and the washed cloth, the results being expressed as percent soil removal. Because of variations in degree and type of soiling, in water and in cloth, and other unknown variables, the absolute value of percent soil removal is not an accurate measure of the detergent effectiveness and cannot be used to compare various detergents. Therefore, the art has developed the method of using relative detergency ratings for comparing detergent effectiveness.

The relative detergency ratings are obtained by comparing and correlating the percent soil removal results from solutions containing the detergents being tested with the results from two defined standard solutions. The two standard solutions are selected to represent a datergent system exhibiting relatively high detersive characteristics and a system exhibiting relatively low detersive characteristics. The systems are assigned detergency ratings of 6.3 and 2.1, respectively.

By washing portions of each soiled cloth with the standardized solutions, as well as with two test solutions, the results can be accurately correlated. The two standard solutions are identical in formulation but are employed at different hardnesses.

| Standard Solution Formulation | |
|---|---|
| Ingredient | Weight % |
| Linear Alkylbenzene sulfonate (LAS) | 25 |
| Sodium triphosphate | 40 |
| Water | 8 |
| Sodium sulfate | 19 |
| Sodium silicate | 7 |
| Carboxymethylcellulose | 1 |

The standard exhibiting high detersive characteristics (Control B) is prepared by dissolving the above formulation (1.0 g.) in 1 liter of 50 ppm hard water (calculated as $\frac{2}{3}$ calcium carbonate and $\frac{1}{3}$ magnesium carbonate). The low detersive standard (Control A) contained the formulation (1.0 g.) dissolved in 1 liter of 180 ppm water (same basis).

A miniature laboratory washer is so constructed that four different solutions can be used to wash different parts of the same swatch. This arrangement ensures that all four solutions are working on identical soil (natural facial soil). Relative detergency ratings (RDRs) are calculated from soil removals (SRs) according to the equation:

$$RDR = 2.1 + 4.2 \frac{\% SR_{Test} - \% SR_{Control\ A}}{\% SR_{Control\ B} - \% SR_{Control\ A}}$$

A further refinement in the determination of relative detergency ratings was developed. In this method, instead of employing two standard formulations, one of the formulations used in preparing the four test solutions had a known relative detergency rating (RDR) which had been determined by the above formula. Relative detergency ratings of the other three formulations were then determined by comparing the percent soil removal (SR) of these formulations with that of the known formulation.

The following table presents detergency data on a group of representative ring-disulfonated alkylphenoxy alkylols. For comparison, the detergency rating is given for a linear alkylbenzene sulfonate (LAS) (having from 11 to 14 carbon atom straight chain alkyl groups) both with and without a phosphate builder.

Each formulation of the instant invention tested comprised 25 weight percent of the test material along with 1% carboxymethylcellulose, 7% sodium silicate, 8% water, and 59% sodium sulfate. The LAS comparison formulation without phosphate was prepared in the same way. The LAS-phosphate formulation contained 20% LAS, 40% sodium triphosphate, 1% carboxymethylcellulose, 7% sodium silicate, 8% water and 24% sodium sulfate. The test results were obtained at a pH of 7 except for the two LAS examples, which were run at a pH of 9 (without phosphate) and 10 (with phosphate). The tests were run at a concentration of 0.15% by weight in water. The alkylphenols were those produced by catalytic alkylation with internal olefins. The alkyl groups contain from 18 to 20 carbon atoms. The test compounds marked by an asterisk had ortho alkyl attachment greater than 90%, the remainder being predominately para. In the other test compounds the alkyl groups were about 60% ortho, 40% para attached.

TABLE

| Test No. | Compounds Tested | Relative Detergency Rating (at 0.15% concentration) 50 ppm water | 180 ppm water |
|---|---|---|---|
| 1 | Linear Alkylbenzene Sulfonate (LAS) | 3.8 | 0.5 |
| 2 | LAS (20%) Sodium Triphosphate (40%) | 6.2 | 3.7 |
| 3* | Ring Polysulfonated Alkylphenoxy Ethylol | 4.9 | 3.0 |
| 4* | " | 4.6 | 3.4 |
| 5 | " | 4.7 | 2.1 |
| 6 | " | — | 2.9 |

These data show that the ethoxylated materials are effective detergents in the absence of phosphte builders.

The effect of the addition of hypochlorite bleach to the capped and uncapped materials was determined in a miniature Terg-O-Tometer test. This test was employed rather than the detergency test previously described because with this test the bleach may be added at the beginning of the wash cycle as is common practice in household washing machines. In this test a miniature laboratory washer is employed that is so constructed that two standard formulations and two test formulations can be used to wash different parts of the same soiled swatch. This arrangement ensures that all formulations are working on identical soil (natural facial soil, as employed in the previously described test). The standard formulations employed differ from those employed in the previously described tests. They are as follows:

| Formulation for the low detersive standard (Control A): | |
|---|---|
| Ingredient | Weight % |
| Alkylbenzene sulfonate | 35 |
| Sodium triphosphate | 40 |
| Water | 8.5 |
| Sodium sulfate | 8 |
| Sodium silicate | 7 |
| Carboxymethylcellulose | 0.8 |

| Formulation for the high detersive standard (Control B): | |
|---|---|
| Ingredient | Weight % |
| Linear alkylbenzene sulfonate (LAS) | 7.5 |
| Tallow alcohol sulfate | 10 |
| Sodium triphosphate | 47.5 |
| Water | 10 |
| Sodium sulfate | 13 |
| Sodium silicate | 5 |
| Carboxymethylcellulose | 1 |

The standard exhibiting high-detersive characteristics was prepared by dissolving a relatively large amount of the above formulation (Control B) (2.0 g) in 1 liter of 300 ppm. hard water (calculated as ⅔ calcium carbonate and ⅓ magnesium carbonate). The low detersive standard contained a relative low concentration of the formulation (Control A) (1.0 g) dissolved in 1 liter of 300 ppm. water (same basis).

Relative detergency (RD) values were calculated from soil removals (SR), according to the equation:

$$RD = 2 + 4\frac{\%\ SR_{Test} - \%\ SR_{Control\ A}}{\%\ SR_{Control\ B} - \%\ SR_{Control\ A}}$$

In the test the products of Examples 1 and 2 were compared. Example 2 was a product containing an average of one ethoxy group per molecule. The formulations were tested at a concentration of 0.10% in 50 ppm water. At the beginning of the wash cycle 180 ppm of sodium hypochlorite was added to each sample. The uncapped material (Example 1) showed no improvement in detergency upon bleach addition. The capped material showed an improvement of 1.8 in detergency units after bleach addition.

While the character of this invention has been described in detail with numerous examples, this has been done by way of illustration only and without limitation of the invention. It will be apparent to those skilled in the art that modifications and variations of the illustrative examples may be made in the practice of the invention within the scope of the following claims.

We claim:

1. In a method of washing fabric by contacting said fabric with an aqueous solution containing a detergent amount of detergent active material under conditions of time and temperature to effect substantial soil removal from the fabric, the improvement which comprises carrying out the washing at substantially neutral pH and in the absence of phosphate builders and employing as detergent active material ring polysulfonated alkylphenoxy alkylols of the formula

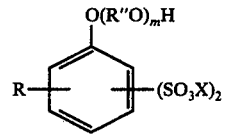

in which R is linear alkyl of 16 to 22 carbon atoms, X is H or a water-soluble salt-forming cation, *m* is 1 to 10, and R" is alkylene of 1 to 5 carbon atoms, the attachment of said linear alkyl R being greater than 90% ortho.

2. The method of claim 1 in which R" is ethylene and *m* is 1 to 5.

3. The method of claim 1 in which *m* is 1 to 3.

4. The method of claim 3 in which *m* is 1.

* * * * *